United States Patent [19]

Tilby et al.

[11] 3,976,498

[45] Aug. 24, 1976

[54] SUGARCANE SEPARATION

[75] Inventors: Sydney Edward Tilby, Winterburn; William C. W. Mason; Donald William Hodge, both of Edmonton, all of Canada

[73] Assignee: Canadian Cane Equipment Ltd., Edmonton, Canada

[22] Filed: Nov. 9, 1972

[21] Appl. No.: 305,098

[52] U.S. Cl. ..... 127/2; 83/425; 83/856; 99/537; 152/7; 156/259; 198/76; 193/2 R

[51] Int. Cl.[2] ..... C13C 1/02

[58] Field of Search ..... 127/2; 156/259; 99/537; 198/76; 146/222

[56] References Cited

UNITED STATES PATENTS

| | | | |
|---|---|---|---|
| 1,700,571 | 1/1929 | Milne | 29/121 |
| 2,572,276 | 10/1951 | Moe | 152/7 |
| 3,082,683 | 3/1963 | Justus | 100/93 |
| 3,424,611 | 1/1969 | Miller | 127/2 |
| 3,424,612 | 1/1969 | Miller | 127/2 |
| 3,464,877 | 9/1969 | Miller | 156/259 |
| 3,566,944 | 3/1971 | Tilby | 198/76 X |
| 3,567,510 | 3/1971 | Tilby | 127/2 |
| 3,567,511 | 3/1971 | Tilby | 127/2 X |

*Primary Examiner*—Morris O. Wolk
*Assistant Examiner*—Sidney Marantz
*Attorney, Agent, or Firm*—Burns, Doane, Swecker & Mathis

[57] ABSTRACT

A material-feeding roll comprises a cylindrical body being at least partly composed of an elastomeric material having longitudinal apertures disposed therethrough and a plurality of tines extending therefrom.

A rotary mounting assembly for a rotatable body comprises a bearing and a hollow axle member. The axle member has a tapered gripping portion for engagement within an aperture carried by the rotatable body. A tightening element is provided and is extendable through the hollow axle member into securing contact with the body to attach the axle member to the body in rotation-transmitting engagement.

A material deflecting chute comprises a concave surface and a plurality of walls on the concave surface forming channels which are widened from an intake end of the chute toward a discharge end thereof.

An apparatus for aligning and conveying elongate material comprises a base conveyor above which are arranged a series of parallel divider walls, with an aligner belt being arranged to travel along at least the upper periphery of each divider wall toward a discharge end of the base conveyor. The aligner belts are controlled so as to travel at a different speed than the base conveyor to effect alignment of the material during conveyance thereof toward the discharge end of the base conveyor.

A toothed gripping roll for controlling the speed of stalk material being milled has non-radially extending teeth to resist impaling and slashing of the fibrous structure thereof.

14 Claims, 16 Drawing Figures

B
150
151
152
154
156
160
162
164
166
170
172
174
175
176
178
180
181
184
186
188
190
192
198
200
202
204
208
209
210
212
216
218
220
222
224
226
228
230
234
236
240
250
270
286
290P
290R
291P
291R
292
292'
293
294
294'
297
P
R

FIG. 16
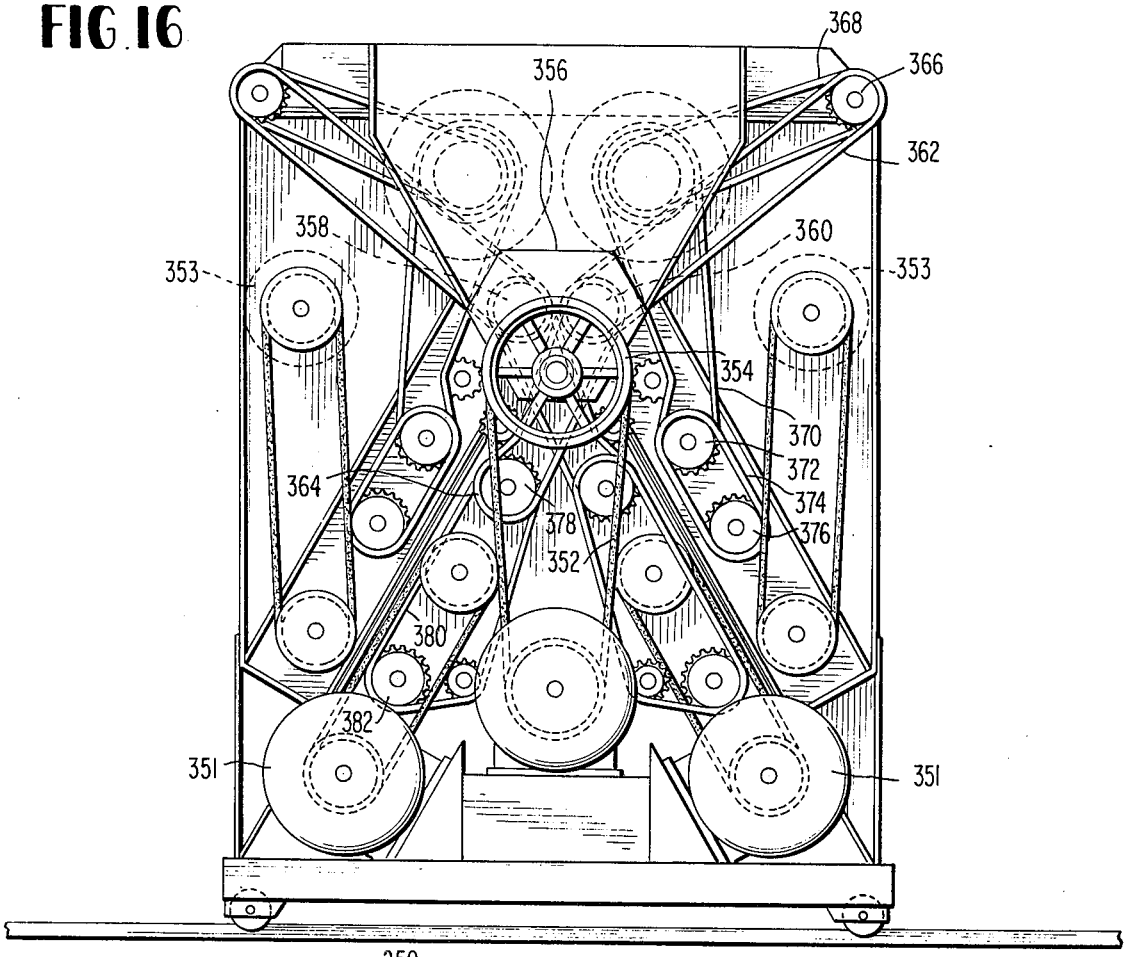
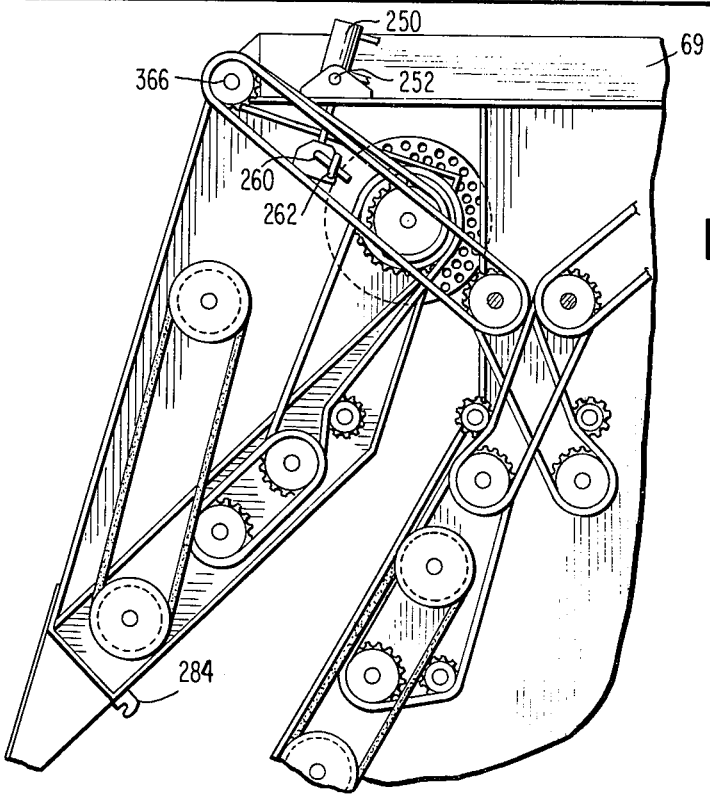
FIG. 11
FIG. 12
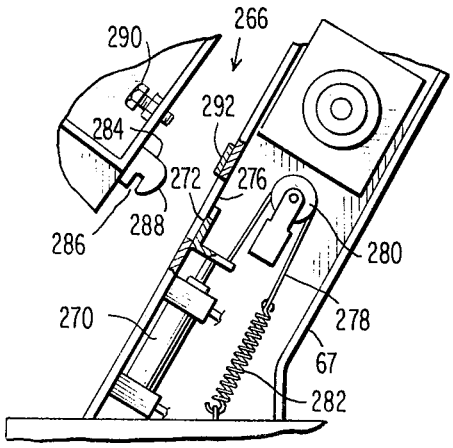

SUGARCANE SEPARATION

RELATED PATENTS

This invention relates to improvements in sugarcane separation as disclosed, for example, in U.S. Pat. Nos. 3,424,611; 3,424,612; 3,464,877; 3,464,881; 3,566,944; 3,567,510 and 3,567,511, all assigned to the assignee of the subject invention, and the disclosures of which patents are hereby incorporated by reference.

BACKGROUND OF THE INVENTION

This invention relates to methods and apparatus for processing material, and more particularly to a method and apparatus for processing sugarcane in which sugarcane stalk material is separated into component parts.

Sugarcane stalk consists of an outer epidermis material, an intermediate fibrous material called rind, and a central pulpous material called pith. Significantly, the pith and rind components of the sugarcane each contain sugar juices as well as other valuable substances, including fibrous materials.

It has been recognized that increased utilization may be made of sugarcane stalk material if at least the pith and rind components thereof are individually separated from each other prior to extraction of the sugarcane juices, rather than subjecting the stalk material to a conventional whole cane milling treatment which crushes the whole stalks to a point where all the stalk components are intermingled such that the juice is contaminated and the rind has lost much of its integral fibrous structure.

Through such separation, the pith component of the sugarcane may be individually processed to obtain sugar juices and various other fibrous and non-fibrous components. The rind portion, with its fibrous structure still substantially intact, can be treated for the extraction of sugar juices as well as other materials such as, for example, lignin, natural resins, and certain minerals. The rind can then be dried and used in making certain commodities such as paper and pressboard. If desired, the epidermis portions may be removed from the rind and treated to recover wax and other components.

A distinct discovery in the art for accomplishing an effective separation of stalk components was provided by Robert B. Miller who recognized that disintegration of sugarcane as proposed, for example, by U.S. Pat. No. 1,040,559, and as is involved in conventional whole stalk crushing, is not the answer to effective pith and rind separation. Miller proposed the splitting of sugarcane stalk, followed by scooping or brushing pith from the stalk halves without substantially disturbing the fiber structure of the rind. The Miller contribution and technique is disclosed, for example, in U.S. Pat. Nos. 3,424,611, and 3,464,877, referred to above. The major breakthrough in sugarcane processing technology provided by Miller opened the door to the development of improved commercial facilities for handling sugarcane stalk and separating its components.

A significant advance in the sugarcane component separation art has been contributed by the present inventor who proposed a systematic technique for rapidly handling large quantities of sugarcane stalk material in which the stalk components are effectively separated. In one aspect of this technique a channeled chute is utilized for guiding a flow of stalk material to a resilient feed roll assembly. The resilient feed roll assembly is arranged to yieldably grip opposite sides of sugarcane stalks and feed the stalks against a slitting blade. The particular arrangement of the feed rolls and slitting blade, as well as the use of a yieldable gripping assembly, enables a large number of stalks to be simultaneously fed and opened-up at a high rate. The opened-up stalk halves each pass between and are flattened by a pair of opposed milling and gripping rolls. During passage, the milling roll scrapes pith from one side of the stalk while the gripping roll controls the rate of stalk movement. This technique is described in detail, for example, in U.S. Pat. No. 3,567,510, referred to previously. It will be apparent that the methods and appartus disclosed therein have opened a new dimension in the art of sugarcane stalk processing in which effective stalk separation may be accomplished by means of high speed equipment which is capable of rapidly handling large quantities of stalk material.

Although the above-discussed separation methods and apparatus are capable of effectively processing a relatively heavy flow of rapidly moving stalk material, there remains room for improvements in efficiencies and techniques in various areas of operation.

For example, a chute which has been used for guiding a flow of stalk material to a separator unit includes a series of parallel guides or channels. The occurrence of varying concentrations of stalk material of random widths within a channel may tend to restrict the material flow, thereby resulting in an uneven flow rate, or may cause clogging of the channel, thus cutting off the flow of material to the separator.

In some instances, where the stalk material is being fed by the feed rolls against the splitting blade, there may develop some skewing and slippage of the stalks relative to the feed rolls. As a result, the efficiency, rate of production, and uniformity of results tend to be reduced.

In other cases where the separated rind components of the stalk material are to be fed to a shredding unit, it is preferable that they be longitudinally aligned for an effective shredding operation. Considerations of time and space dictate that a compact aligning apparatus capable of rapid and effective operation be provided.

The significance of other problem areas will be apparent upon considering that a shutdown of the apparatus for extended periods can result in a significant loss in production. Indeed, the time and effort involved in the performance of maintenance operations such as disassembling the separator apparatus for cleaning or replacing machine parts can be costly. Thus, it would be advantageous to develop methods and apparatus for reducing such time and effort, as well as avoiding or reducing the frequency of stalk jam-ups and other stalk and rind handling problems.

OBJECTS AND SUMMARY OF INVENTION

It is therefore a general object of the invention to provide a method and apparatus which will obviate or minimize problems of the types previously described.

It is another general object of the invention to provide improved methods and apparatus for efficiently and effectively processing sugarcane stalk material.

It is a primary object of the invention to provide an improved method and apparatus for effecting a positive gripping and feeding of material.

It is likewise a principal object of the invention to provide an improved rotary mounting assembly for affording rapid and simplified assembly of a rotary body.

It is another object of the invention to provide an improved chute structure for guiding and re-orienting a flowing mass of material, while reducing the tendency for the flow to become restricted during travel along the chute.

Another principal object of the invention is to provide an apparatus for the handling and processing of material, such as sugarcane stalk material, in which rapid access to the components of the apparatus is facilitated.

It is a particular object of the invention to provide an improved method and apparatus for longitudinally aligning elongate material.

It is yet a further object of the invention to provide an improved apparatus for handling fibrous material in a manner reducing the occurrence of damage to the fibrous components thereof and the tendency for fibers to obstruct efficient operation of the apparatus.

BRIEF SUMMARY

In accomplishing at least some of these objects there is provided, according to a preferred embodiment of the invention, a feed roll having a generally cylindrically shaped body, with at least an outer portion of the body being composed or fabricated of a resilient material. A plurality of apertures or holes are located in the outer portion and extend end-to-end therethrough, parallel to the roll axis. Tines or spikes are mounted in the outer portion and extend, i.e., project, outwardly therefrom. The feed roll, upon contacting material to be fed or advanced, will positively engage the material in a manner facilitating a controlled feeding of the material. The positive engagement and controlled feeding are achieved through the tines which impale or pierce the material and which act in conjunction with the apertured resilient material which is yieldable and which deforms around the periphery of the material being fed.

The feed roll may also include a plurality of axially spaced grooves disposed around its periphery to define a series of flexible ridges. The ridges are capable of conforming to the shape of the material being fed to further enhance the control over such material.

Another independently significant facet of the invention involves a method of feeding stalk material including the steps of resiliently gripping the stalk material between a pair of circumferentially grooved resilient surfaces, impaling the stalk material with tined members extending from the surface grooves, and imparting movement to the grooved surfaces to advance the stalk material.

A further independently significant aspect of the invention involves a rotary mounting assembly for a roll body which includes a rotary bearing and an axle element mountable therein. The axle element comprises a hollow axle member having a rotational support portion adapted to be carried by the bearing and a tapered gripping portion which is insertable within a mounting aperture of the body. A tightner is extendable through the axle member for engagement with the body for drawing the gripping portion into force-transmitting engagement with the body. The support and gripping portions are both dimensioned to afford passage thereof through the bearing, thereby facilitating a rapid and convenient assemblage and disassemblage of the roll body.

Other independently significant aspects of the invention relate to the use of a material deflecting chute which includes an arc-shaped deflector plate having a concave surface and a plurality of channel-defining walls extending therealong. The channels are configured so as to present a gradually increasing width from an intake end to a discharge end of the chute. Material which enters the chute will travel along a progressively widening path and will be subjected to less restricting effects as might be caused by contact of the stalk with parallel channel walls.

Still further independently significant facets of the invention involve apparatus for rapidly opening and closing the frame assembly of a stalk separator unit. The frame assembly includes a base portion and wing portions pivotally mounted to the base portion. The opening and closing apparatus comprises a first power-operated mechanism for selectively locking the wing means and base portion together and a second power-operated mechanism connected between the wing portions and base portion for inducing relative swinging movement therebetween. The two power mechanisms may be in operative interconnection so as to function sequentially upon being activated. In this manner, rapid access to the frame assembly interior for servicing thereof is facilitated.

Still other independently significant aspects of the invention pertain to operations for aligning elongate material. According to the invention, a base conveyor is provided which, together with a series of overhanging walls, define a plurality of feed paths. Aligner belts are disposed for traveling movement along the upper edges of the walls in the direction of conveyor movement. The speed of the aligner belts is regulated so as to be different than the conveyor speed. Elongated material which is fed onto the conveyor and which is in a generally longitudinally aligned posture will fall between the walls and onto the conveyor. Non-aligned material may come to rest in a leaning position against the aligner belts and will be shifted to an aligned posture due to the relative speeds of the aligner belt and conveyor. A series of rotatable kick-back wheels may be disposed adjacent the ends of the aligner belts to displace any material carried along by the aligner belts.

A yet further independently significant aspect of the invention involves the utilization of a toothed gripping roll for engaging one side of fibrous stalk material while the opposite side is being milled, in order to control the speed of the stalk material with minimal damage occurring thereto. The teeth of the gripping roll extend non-radially toward oncoming stalk material to effectively grip the material while resisting the tendency to slash or rip the fibrous structure.

A support plate may be arranged downstream of the gripping roll to support stalk material which is fed thereto from the gripping roll. The support plate is provided with an extension projecting into the roll discharge zone, i.e., the area immediately downstream of the roll milling region. The extension presents a generally rounded, smooth configuration at its terminal end to resist the snagging of stalk fibers thereon.

THE DRAWINGS

In describing the invention, reference will be made to preferred embodiments illustrated in the appended drawings.

FIG. 11 is a partial side elevational view of a separator unit in an open, non-operating position;

FIG. 12 is an enlarged partial sectional view of a locking mechanism incorporated in a separator unit;

FIG. 16 is an elevational view of a separator unit according to a preferred embodiment of the invention in operating position.

DETAILED DESCRIPTION OF A PREFERRED EMBODIMENT OF THE INVENTION

Figures 1, 2, 3, 4, 5, 6, 7:
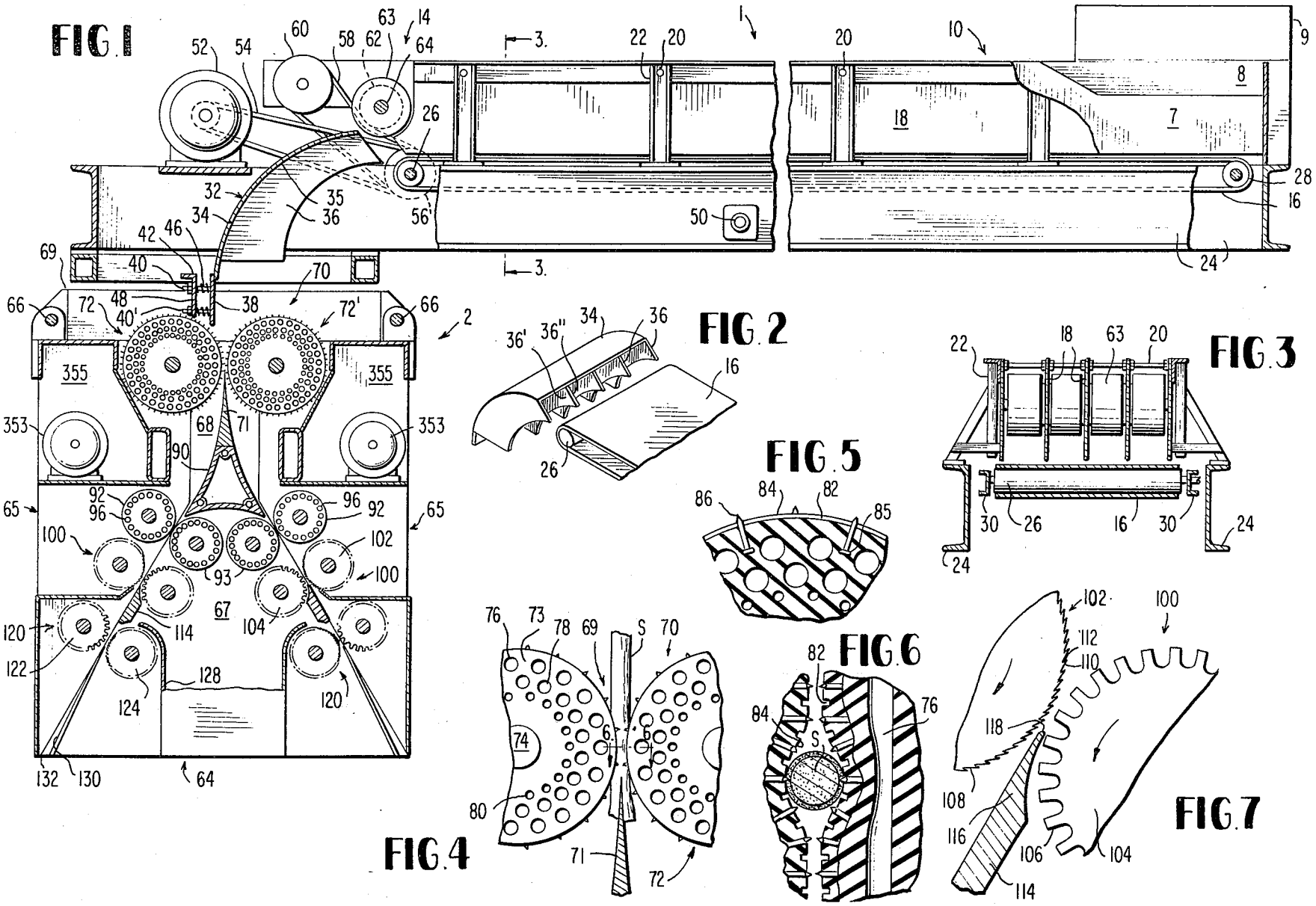
FIG. 1 is a partially sectioned side elevational view of a delivery unit and a separator unit according to a preferred embodiment of the invention.
FIG. 2 is a segmental perspective view of a chute comprising a portion of the delivery unit.
FIG. 3 is a transverse sectional view of the delivery unit taken along section line 3—3 in FIG. 1.
FIG. 4 is an enlarged partial sectional view of a pair of feed rolls incorporated in the FIG. 1 separator unit during a stalk-slitting operation.
FIG. 5 is a segmental transverse sectional view of a feed roll.
FIG. 6 is a segmental longitudinal sectional view taken along section line 6—6 in FIG. 4.
FIG. 7 is an enlarged segmental sectional view of a pith-milling station incorporated in FIG. 1 separator unit.
Figure 14:
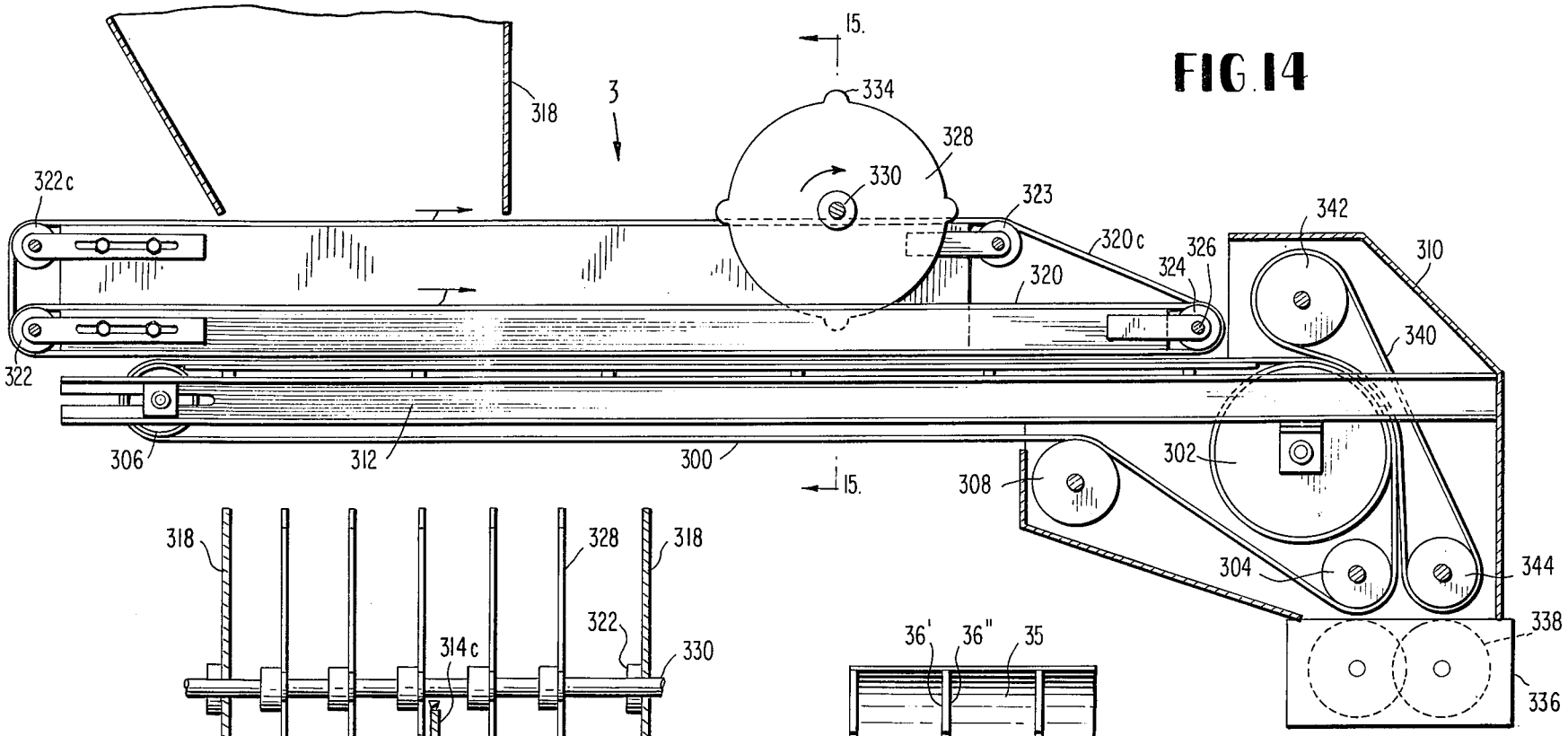
FIG. 14 is a longitudinal partially sectioned view of a shredder unit according to a preferred embodiment of the present invention.

The sugarcane handling apparatus according to the preferred embodiment of the invention consists basically of a delivery unit 1, a separator unit 2, and a shredder aligning unit 3, as shown in FIGS. 1 and 14. The delivery unit 1 functions to longitudinally align pieces of cane stalk material in the direction of feed for delivery to the separator unit. The separator unit contains means for longitudinally slitting each stalk piece and milling away the pith and optionally the epidermis portions of the stalk halves. The separated rind portions of the stalk material may be subsequently delivered to the shredder aligning unit 3 (FIG. 14) for being longitudinally aligned in preparation to being fed into a shredding device.

DELIVERY UNIT

The delivery unit 1, as best seen in FIGS. 1, 2 and 3, consists of an aligning and feeding zone 10 and a delivery station 14. The aligning and feeding zone 10 is similar to that shown in U.S. Pat. No. 3,567,511, referred to previously, and consists of a series of alternately disposed short and tall walls 7 and 8, respectively, which are positioned below an open chute 9. The walls 7 and 8 cooperate with a delivery base conveyor belt 16 to longitudinally align cut cane stalk material which is dropped through the open chute 9. The aligned stalk material travels along the base conveyor 16 to the delivery station 14.

The walls 7 and 8 include forwardly projecting sections 18 which extend from the delivery conduit 9 to the delivery station 14. The wall sections 18 are disposed above the base conveyor belt 16 to define therewith a plurality of parallel feed paths for the stalk material. In this connection, the wall sections 18 are attached at their upper ends to a series of spaced rods 20, the rods being carried by support arms 22 which are mounted on frame parts 24. The conveyor belt 16 is rotatably supported by means of fore and aft rotary drums 26 and 28, respectively. The drums are rotatably carried by auxiliary beams 30 which are suitably secured to the frame parts 24.

The delivery station 14 includes a deflecting chute 32 which functions to guide stalk material from the conveyor 16 downwardly into the separator unit 2. The chute 32, as best seen in FIGS. 1 and 2, includes an arc-shaped deflector plate 34 which presents a concave surface 35 facing the conveyor 16. A plurality of divider walls 36 extend outwardly from the concave surface 19 to define a series of downwardly curved channels. The divider walls 36 are disposed in longitudinal alignment with the wall sections 18 such that the channels defined by the walls 36 are generally contiguous with the feed paths defined by the wall sections 18. The chute 32 and the conveyor belt 16 are arranged such that the stalks which are propelled toward the upper, intake end of the chute by the conveyor belt will strike the concave surface of the deflector plate 34 and will be deflected downwardly thereby toward a discharge end of the chute.

Figure 17:
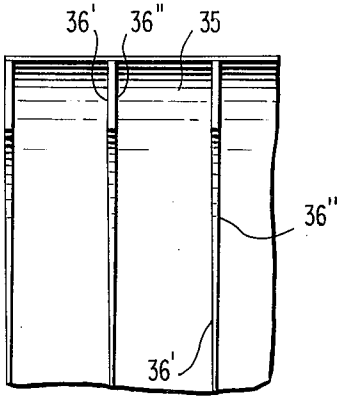
FIG. 17 is a partial front elevational view of the delivery chute, taken in the direction of stalk travel toward the chute.

To resist the tendency for stalk material to become wedged between the divider walls 36, and thus restricting flow, each divider wall comprises a pair of faces 36' and 36'' which converge toward the discharge end of the chute (FIG. 17). The channels formed by the opposing faces of adjacent divider walls thus become gradually wider toward the discharge end. Consequently, concentrations of stalk material, which might otherwise cause restrictions and clogging, will be more readily accommodated by the progressively widening channels.

A guide plate 38 is provided at the discharge end of the chute 32 and defines a downward extension of the deflector plate 34. The guide plate 38 is mounted so as to be yieldable with respect to the deflector plate 34. In this connection, the mounting includes two pairs of upper and lower pins 40 and 40' disposed at the ends of the guide plate (only one pair shown). Each pair of pins 40, 40' is slidably mounted within an apertured limit bar 42, there being a limit bar disposed at each end of the guide plate. The limit bars 42 are suitably attached to the frame parts 24 and are positioned so as to straddle the feed roll located therebelow. The pins 40 and 40' are provided with compression springs 46 to bias the guide plate 38 toward the deflector plate 34. A stop nut 48 is threaded onto the ends of the pins to enable the rest position of the guide plate to be adjusted. The guide plate 38 is arranged so as to extend into the nip zone 69 between the feed rolls 72 and 72' of the separator unit. In this fashion, the guide plate will yieldably direct stalks into the nip zone and will be operable to cushion the impact of stalk material striking thereagainst, thereby reducing any tendency of the stalk material to change its general direction of downward movement and possibly clog the chute 32 and nip zone area 69.

In order to enable the guide plate to be lifted from the nip zone, to permit the separator unit 2 to be transported from beneath the chute 32, the delivery unit 1 is pivotally mounted at 50 to any suitable stationary frame structure. In this manner, the guide plate may be swung upwardly from the nip zone so as to avoid obstructing movement of the separator unit.

In order to provide driving power for the delivery conveyor belt 16, a motor 52 is mounted on the frame parts 24 and is drivingly connected by means of a belt 54 to a drive pully 56 which is attached to the drum 26. A secondary belt 58 extends between an idler pulley 60 and an additional pulley which is coaxial with the drum 26. The secondary belt 58 is maintained in frictional driving engagment with a wheel 62 which is carried by a rod 64.

A plurality of overhead rollers 63 are mounted on the rod 64 for rotation therewith and are disposed adjacent the ends of the feed paths formed by the separator walls 18 (FIGS. 1 and 3). The overhead rollers thus overlie the upper limits of the feed paths at the end of the conveyor belt to inhibit the escape of any upwardly and outwardly traveling stalks and to facilitate feeding of the stalks to the chute 32 as the rollers are rotated by the belt 58.

From the foregoing it will be apparent that in operation, the delivery unit serves to longitudinally align stalk material and deliver the aligned stalk material to the separator unit, while avoiding or minimizing any clogging or misalignment with respect to the separator unit.

SEPARATOR UNIT

The separator unit comprises a base and wing means pivotally secured thereto. Included therein are stalk-slitting and stalk-milling stations for longitudinally cutting the stalks in half and separating components of the stalk halves. Also included is a power operated mechanism for opening and closing the wing means with respect to the base.

More specifically, a stationary base portion 64 has secured thereto a pair of identical wing sections 65. The wing sections are pivotally mounted at 66 to the base portion and are operable to be swung between a closed, operable, position (FIG. 1) and an open, inoperative, position (FIG. 11). The wing sections include rotary roll members which cooperate with elements of the base in the stalk slitting and milling operations. Since each of the wing sections are identical, the separator unit will be mainly described with reference to a single wing section.

SPLITTING STATION

The separator unit includes a stalk-splitting station 70, best illustrated in FIGS. 1, 4, 5, and 6. The splitting station includes a cutting blade 71 and a pair of feed rolls 72 and 72' for advancing stalk material against the blade. The cutting blade 71 is fixedly secured to the base 64 in an upstanding manner. The feed rolls 72 and 72' are rotatably mounted on the wing sections 65 adjacent the edge of the cutting blade 71. The feed rolls are spaced so as to define a nip zone 69 therebetween. Upon rotation, the feed rolls 72, 72' are operable to grip opposite sides of stalk material which is directed into the nip zone from the chute 32. Continued rotation of the feed rolls causes the stalk material to be fed towards and impinge against the cutting blade 71 whereby each stalk piece is split longitudinally in approximate halves (FIG. 4).

At least the outer portion of each feed roll 72, 72' is preferably fabricated from an elastomeric material, such as natural or synthetic rubber. The material is sufficiently resilient or elastic to allow the outer gripping surfaces to deform around or at least partially envelop the stalk material and then recover to substantially the original cylindrical shape after the material has been fed, yet is sufficiently durable to resist significant wear. As will be subsequently described, the feed rolls are designed to provide a maximum amount of control over the stalk material without sacrificing the durable nature of the rolls.

More specifically, the feed rolls of the present invention each include a resilient outer portion 73 which is provided with apertures extending end-to-end therethrough in a direction parallel to the feed roll axis. In a preferred form of the invention, illustrated in FIGS. 1, 4, 5, and 6, the apertures comprise three groups of apertures 76, 78, 80, each group being arranged in a generally circular pattern around the rotary axis of the feed roll. The apertures of the outermost group 76 are staggered with respect to the apertures of the intermediate group 78, i.e., the apertures of the outermost group 76 lie in different radial planes than the apertures of the intermediate group 78. The apertures of the intermediate group 78 are, in turn, staggered with respect to the apertures of the innermost group 80.

The provision of apertures in the outer feed roll portion reduces the resistance to radial compression of the roll. The feed roll is thus able to more effectively envelop the stalk material during a feeding operation as shown in FIG. 6. Consequently the feed roll will maintain a greater degree of control over the stalk and will resist tendencies of the stalk to become misaligned, or skewed, as it is being fed.

Although the provision of apertures has been described in connection with FIGS. 4 and 5 wherein the apertures are arranged in staggered groups, it will be apparent that any number of suitably-sized apertures may be provided, in any suitable circular or other arrangement, to establish in the feed rolls an appropriate degree of resiliency.

As a further means of enhancing the amount of control which is imposed over the stalk material, the outer peripheral surface of each feed roll is provided with a plurality of axially spaced circumferential grooves 82. The grooves 82 define therebetween a series of flexible circumferential ridges 84. These ridges are sufficiently pliable to enable the outer surfaces thereof to conform generally to the irregular contour of the stalk material which contains nodes or bands along its length. This increases the frictional gripping engagement which is afforded between the feed rolls and the stalk material and resists skewing of the stalks.

A still further increase in the effective engagement between the feed rolls and the material to be fed occurs through the provision of sharpened tines 86 in the outer feed roll periphery. These tines may take the form of sharpened nails, spikes or the like which are suitable for impaling the stalk material. The tines 86 are preferably utilized in conjunction with the circumferential grooves 82 and are disposed therein (FIGS. 5 and 6). In this connection, the tines are provided with enlarged head portions 85 which are seated within pockets in the resilient portion of the feed roll so as to be tightly gripped and secured thereby. The sharpened tips of the tines are arranged so as to project from the outer roll surface, as defined by the flexible ridges 84, by a distance sufficient to enable the tines to effectively pierce the outer rind of the stalk material during a feeding operation.

It is desirable that the tines be located apart from one another so as to avoid causing any significant damage to the stalks. Thus, the tines are suitably spaced circumferentially from one another, with the tines of adjacent grooves being relatively staggered circumferentially, as can be seen in FIGS. 5 and 6.

It is apparent that during a stalk-feeding operation, control of the stalk material by the feed rolls will be greatly enhanced by the impaling of the stalks by the tines, as viewed in FIG. 6. Moreover, adjacent tines which do not impale the stalk material may be directed toward or against the stalks to further inhibit skewing thereof as the stalks are driven against the cutting blade 71.

It should be noted that the provision in a feed roll of the previously described features, namely longitudinal apertures, circumferential grooves, and sharpened tines, may be made separately, or in any desired combination to suitably enhance the feeding performance of the feed roll.

In operation, as the feed rolls contact a piece of stalk material, opposite sides of the stalk are subjected to a frictional gripping engagement by the flexible ridges 84 and a direct, impaling engagement by the tines 86 and are positively fed against the blade 71. Due to the provision of the longitudinal apertures the feed roll will be radially displaceable so as to more effectively envelop the stalk. The increased control over the stalk material which is afforded thereby results in a faster and more efficient feeding-splitting operation.

The stalk-splitting blade 71 includes a pair of guiding surfaces 90 for supporting the split stalk material. Each stalk half travels downwardly along a respective guiding surface 90 with the exposed pith bearing side facing the guiding surface.

Each stalk half is subsequently gripped at the lower end of a respective guiding surface by a pair of inner and outer transfer rolls 92 and 93. The outer transfer roll 92 is rotatably mounted on a wing section 65 and the inner transfer roll 93 is rotatably mounted on the base. The transfer rolls are formed of a resilient, elastomeric material, and are smaller in scale than the feed rolls 72, 72'.

One or more groups of longitudinal apertures 96 may be provided in the transfer rolls, extending parallel to the axis, to increase the resiliency of the rolls. In addition, axially spaced grooves, similar to those of the feed rolls 72, 72', may be provided around the periphery of the transfer rolls. A rotational drive mechanism, as will be described later, is connected to the transfer rolls to enable them to transfer slit stalk material from the guiding surface 90 to a pith-milling station 100.

Although only one pair of opposed transfer rolls has been disclosed, it will be apparent that any number of transfer rolls may be provided and suitably positioned for feeding the stalk halves to the pith-milling station.

MILLING STATIONS

Disposed downstream of the transfer rolls are milling means for separating components of the stalk halves. The milling means comprises a pith-milling station 100 and also may include an epidermis-milling station 120.

The pith-milling station 100, shown in FIGS. 1 and 7, comprises a gripping roll 102 and an oppositely disposed milling roll 104. The gripping roll 102 is rotatably mounted on the wing 65 and is provided with a series of pointed teeth 108. The milling roll 104 is rotatably mounted on the base 64 and includes a plurality of radially projecting milling ridges 106.

The gripping roll and the milling roll are spaced apart to accommodate passage of stalk halves therebetween. During such passage, the gripping and milling rolls are power-rotated in the direction of stalk travel so as to continuously feed the stalk in that direction. As the stalk material passes between the gripping and milling rolls, the milling ridges 106 penetrate into the pith component of the stalk and scrape away the pith.

In order to facilitate an efficient removal of pith by the milling ridges, the gripping roll 102 is rotated at a slower speed than the milling roll 104. In this manner, the gripping teeth 108 will grippingly engage the rind side of the stalk and maintain the speed of the stalk at a slower rate than the speed of the milling ridges. This enables the milling ridges to effectively cut through and scrape away the pith.

As the split stalk sections move into the nip zone between the rolls 102 and 104, the converging peripheries of the rolls 102 and 104 will tend to induce a flattening of the rind layer into a substantially planar configuration. This flattening will result from engagement of the milling ridges 106 with the rind edges, concurrent with engagement of rind-gripping teeth 108 with the outermost stalk periphery. Thus, as the stalk half moves forward into the nip zone, the rind layer will be progressively flattened until, in the zones where the radii of rolls 102 and 104 are radially aligned, the rind will be completely flattened.

The epidermis milling station 120, disposed downstream of the pith milling station 100, is comprised of a milling roll 122 and a gripping roll 124. The epidermis-milling roll 122 is rotatably mounted on the wing 65 for milling away the epidermis component of the stalk half. Disposed oppositely from the milling roll 122 and rotatably mounted on the base 64, the gripping roll 124 serves to grip the rind portion of the stalk with teeth similar to those of the gripping roll 102 to control the stalk speed during the epidermis milling operation.

The gripping and milling rolls as heretofore described, are similar to those disclosed in U.S Pat. Nos. 3,567,510 and 3,567,511. According to the present invention, however, the teeth 108 of the gripping rolls 102 and 124, when viewed from the end as in FIG. 7, include a pair of surfaces 110 and 112, both of which extend non-radially in a manner converging toward an oncoming piece of stalk. In previous instances, as can be seen in FIG. 6 of U.S Pat. No. 3,567,510 only one of the converging surfaces extends non-radially, i.e., that surface which is furthest from the oncoming stalk. The teeth defined in such previous instances have exhibited an occasional tendency to impale the stalk to different degrees, thus making it difficult to properly gauge the depth of milling by the milling rolls and possibly causing damage to the rind fibers by slashing the fibers.

By configuring the teeth 108 such that both of surfaces 110 and 112 project non-radially, in accordance with the present invention, the tendency for the teeth to impale and slash the stalk is resisted. Moreover, the gripping or restraining, force which is applied to the stalk material by the gripping rolls 102 and 120 is directed more longitudinally rearwardly with respect to the stalk. This increases the degree of control which is exhibited by the gripping rolls over the stalk material.

Attached to the base between the pith-milling station 100 and the epidermis-milling station 120 is a stalk guiding or supporting plate 114 having a planar upper surface. After a stalk half has been de-pithed at the pith-milling station, the remaining stalk portion, i.e., the epidermis and rind, is passed onto the stalk-guiding plate 114 for delivery downstream to the epidermis-milling station 120. The stalk-guiding plate 114 includes an extension 116 which projects into the discharge zone defined between the rolls 102 and 104 of the pith-milling station. As stalk material is being transferred from the pith milling station to the guide plate 114, tough thin fibrous elements of the stalk may be engaged by and build-up around the terminal end of the extension 116. If these fibers are allowed to build-up on the extension, it may become necessary to shut-down the separator unit in order to dislodge them.

According to the invention, the terminal end 118 of the extension 116 is provided with a generally rounded, smooth configuration in order to promote a sliding action of the fibers from the extension during normal functioning of the machine. As a result, the amount of fiber build-up is significantly reduced if not eliminated altogether.

The separated pith, epidermis and rind components of the stalk material are discharged from the separator unit and may be individually processed. The milled pith drops through a passage in the base 64 formed by a wall section 128, shown in FIG. 1, and falls onto suitable conveyor units.

The rind material is discharged along an inclined ramp 130 of the base. The inclined ramp 130 forms an opening 132 with the wing section 65 and enables this material to pass through the separator unit and onto a suitable conveying apparatus located therebelow.

The rind may be conveyed to a suitable sorting apparatus which separates any residual pith and, if also milled, epidermis loosely adhering to the rind component. Such an apparatus may, for example, take the form of an inclined, cylindrical screen which rotates as the mixture gravitates down its interior, with the epidermis falling through openings in the screen.

Figures 8, 9, 10, 13:
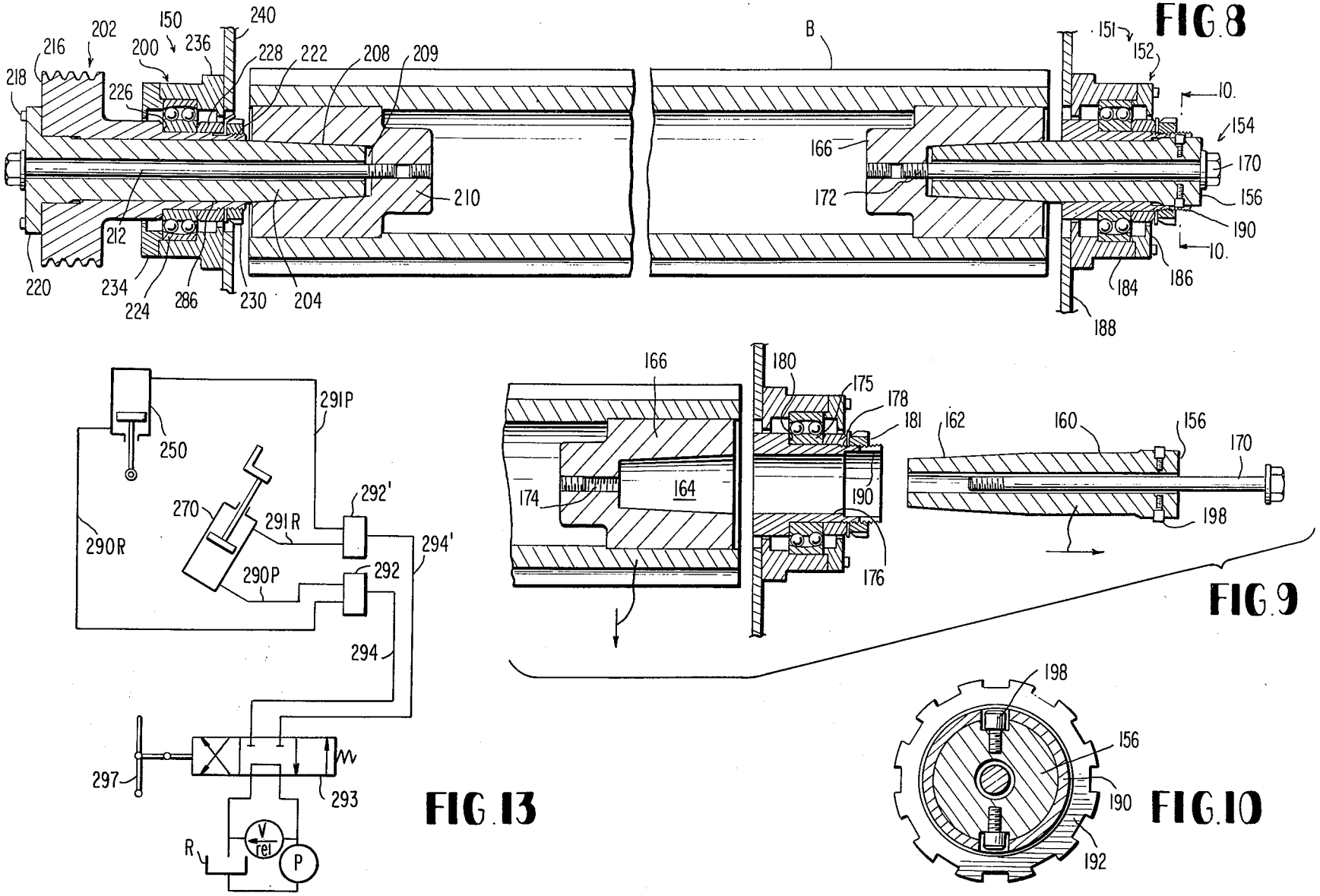
FIG. 8 is a longitudinal sectional view of a rotary mounting assembly according to a preferred embodiment of the invention.
FIG. 9 is an exploded sectional view of a rotary mounting illustrated in FIG. 8.
FIG. 10 is a transverse sectional view taken along section line 10—10 in FIG. 8.
FIG. 13 is a schematic view of a hydraulic fluid-operating system for a plurality of hydraulic cylinders connected to a separator unit.

In operations where the epidermis has also been milled, it may be desirable to employ a vacuum unit arranged adjacent to the epidermis milling station to draw away the milled epidermis, as shown in FIG. 9 of U.S. Pat. No. 3,567,511.

ROTARY MOUNTING ASSEMBLY

In the event that one of the rotatable rolls of the separator unit is required to be removed or replaced, it is advantageous that the operation be carried out as quickly as possible to minimize the extent of production stoppage. A rotary mount is provided by the invention for facilitating a rapid and simplified assemblage and disassemblage of the rolls. A preferred form of the rotary mount, however, may be utilized with any suitable rotatable member.

According to the preferred embodiment of the invention, a rotary mounting assembly is provided at each end of a roll body B, as depicted in FIGS. 8, 9, and 10. The roll body B may be any one of the roll members previously discussed. A driven rotary mounting assembly 150 is deployed at the driven end of the roll B with a non-driven rotary mounting assembly 151 being deployed at the other end of the roll. It will be understood, however, that either or both ends of the roll may be provided with a driven mounting assembly 150 in accordance with the teachings of the invention.

The non-driven assembly 151 comprises a bearing assembly 152 and a rotary axle assembly 154. The axle assembly 154 includes a hollow axle member 156 having a rotational support portion 160 and a tapered roll-gripping portion 162. The roll-gripping portion 162 is tapered toward the roll body B. The roll-gripping portion 162 and the rotational support portion 160 are each configured so as to afford passage thereof through the bearing assembly 152. Thus, no cross-sectional portion of the roll-gripping portion is larger than the central opening of the bearing assembly.

The roll-gripping portion 162 is adapted to be inserted into an apertured portion of the roll. The aperture may comprise any suitable opening but preferably comprises a tapered socket 164 provided in a plug 166. The socket 164 is inwardly tapered in a manner generally complementary to the taper of the roll-gripping portion 162. The plug 166 is secured at the end of the roll B by a suitable attachment, such as welding, bolting, or friction fitting.

The axle assembly 154 includes a tightening device for securing the roll-gripping portion 162 within the inner surface of the socket 164. The tightening device is preferably in the form of a bolt 170 having a threaded end 172 for attachment within a threaded hole 174 of the plug 166.

The bearing assembly 152 for the non-driven rotary axle assembly 154 includes a conventional bearing, such as a ball-bearing unit 175. A spacer sleeve 176 is carried within the bearing unit 175 and serves to support a collar 178. The collar 178, together with a shoulder portion 180 of the sleeve 176 embrace opposite sides of the bearing unit 175. A nut 181 is threadably securable to a threaded end of the spacer sleeve 176 to tighten the collar 178 against the bearing unit 175. A casing 184 having a removable end segment 186 is provided for carrying the bearing unit 175 and for attaching the bearing unit to a frame section 188 of the separator unit.

It is apparent that with the casing 184 being suitably attached to the frame section 188 and the nut 178 being tightened on the sleeve 176, the bearing assembly 152 is operable to receive and support the axle assembly 154, as shown in FIG. 9. To facilitate the transmission of torque from the axle member 156 to the sleeve 176 a fitting 190 is threadably securable within the collar 181. The fitting 190 includes a pair of slots which are operable to slidably receive a pair of screws 198 that project from the axle member 156. This slotted connector also accommodates longitudinal expansion of the hollow axle member relative to the bearing assembly in response to thermal effects on the roll B.

At the other end of the rotatable roll 8, the driven mounting assembly 150 comprises a drive bearing assembly 200 and a driving axle assembly 202. The drive axle assembly 202 includes a hollow axle member 204 which has a rotational support portion 206 and a tapered roll-gripping portion 208, the latter being insertable into a complementary-tapered socket 209 of a plug 210. The plug 210 may be fastened within the roll B in a manner similar to the plug 166. A tightening bolt 212 is provided for drawing together the roll-gripping portion and the tapered socket into rotation-transmitting frictional engagement. The rotational support portion 206 and the roll-gripping portion 208 are configured so as to afford passage thereof through the central opening of the bearing assembly 200. The drive axle assembly 202 further includes a power transmitting element such as a grooved pulley wheel 216. The wheel 216 is secured by bolts 218 to a shoulder portion 220 of the axle member 204.

The drive bearing assembly 200 includes a roller bearing unit 224 which is engaged on one side by a shoulder 226 of an extension 222 of the drive wheel 216. A collar 228 abuts against the other side of the bearing unit. A nut 230 is threaded onto the inner end of the wheel extension 222. A pair of housing members 234 and 236 carry the bearing unit 224 and are secured to a frame section 240. Oil seals may be provided between the housing members 234 and 236 and the bearing element 224 to seal the latter.

To install the roll B, the roll is positioned wherein the sockets 164 and 209 are aligned with the central openings of the bearing assemblies 151 and 200. The hollow axle members 156 and 204 are inserted through the bearing assemblies 152 and 200 from the outside, with the roll-gripping portions being brought into engagement with the sockets 164 and 209. The screws 198 are oriented so as to enter the slots of the fitting 190. The bolts 190 and 212 are tightened to draw together the gripping portions and sockets into torque transmitting frictional engagement. Removal of the hollow axle members 156 and 206 from the bearing assembles enables the roll to be easily slipped from between the frames 188 and 240.

WING MANIPULATING MECHANISM

In order to reduce the shut-down periods of the separator unit when performing maintenance thereon, the inner components of the unit should be made easily and quickly accessible. At the same time, however, the base and wing sections of the unit must be tightly secured during operation.

The present invention includes a powered apparatus for manipulating the wings with respect to the base in accordance with such requirements. Accordingly, a powered mechanism is provided for swinging or popping open the wing sections with respect to the base. In addition, a fluid-powered mechanism is provided which can be operated to rapidly lock and unlock the wing sections with respect to the base.

The mechanism for opening and closing each wing section is identical and comprises at least one popper jack 250 which is connected in an extensible and retractible manner between the wing 65 and the base 64. The popper jack may comprise any suitable extendable and retractable device such as, for example, a double acting hydraulic piston-cylinder 250. The popper cylinder 250 is pivotally mounted by a pin 252 to the base 64. A rod element 256 of the popper cylinder is pivotally connected to a bracket 258 on the wing 65 by a removable pin 260. A locking bar 262 is fastened to the bracket 258 and extends outwardly and upwardly therefrom to define therewith a locking channel into which a handle portion 264 of the pin 260 may be swung to secure the pin against removal from wing. The popper cylinder 250 is provided with hydraulic fluid conduits which are connected to a conventional hydraulic pump and valve assembly for alternately directing fluid to the conduits to swing the wing between opened and closed positions.

If it is required to open the wings to a greater degree than is afforded by the popper cylinder 250, the pivot pin 260 may be removed to accommodate further lifting of the wing by a hoisting cable or the like.

The mechanism for locking each wing to the base is identical and comprises at least one powdered latching assembly 266 (FIG. 12). The latching assembly 266 includes a hydraulic locking cylinder 270 attached to the base, with a latch plate 272 being mounted at the outer end of its piston rod. The latch plate 272 is operable to be moved toward and away from a bracketreceiving opening 276 located in the base.

A cable 278 is secured at one end to the plate 272, and extends around a pulley 280 which is rotatably mounted on the base. A tension spring 282 is attached between the base and the other end of the cable 278 to bias the locking cylinder to an extended position. The locking cylinder 270 is attached to a suitable hydraulic pump and valve assembly for reciprocating the plate 272 toward and away from the opening 276.

The latching assembly further includes a wing-mounted bracket 284 which carries a slot 286 and a curved end sector 288. The bracket 284 is operable to pass through the opening 276 when the wing is swung to a closed position.

When the wing is in a closed and locked position and it becomes necessary that it be opened, the latch plate 272 is retracted by the locking cylinder 276 to release the bracket 284. This unlocks the wing and enables it to be swung open by the popper cylinder 250. Conversely, when the wing has been swung closed and the bracket 284 has passed through the opening 276, the locking cylinder is shifted to extend the latch plate 272 into the slot 286. The spring 282 provides a bias tending to prevent retraction of the locking cylinder until pressured fluid is applied thereto.

An adjustable stop bolt 290 is threadely positioned on the wings and is engageable with a hardened plate 292 on the base to provide means for adjusting the relative position of the wings and base during operation.

While the above-described operation may be performed simply and quickly, an automatic sequentially-operating hydraulic system can be utilized to manipulate the wing sections. A system of this type is illustrated in FIG. 13. The rod end of the popper cylinder 250 and the piston end of the locking cylinder 270, associated with each wing, are provided with fluid conduits 290R and 290P, respectively. The piston ends of the popper cylinder and locking cylinder are provided with fluid conduits 291R and 291P respectively. The conduits 290R, 290P and 291R, 291P communicate with conventional pressure - actuated sequencing valves 292 and 292', respectively. These valves 292 and 292' are fluidly connected to a control valve 293 by means of conduits 294 and 294'. The control valve is coupled to a fluid pump P by a conduit 295 and to a fluid reservoir R by a conduit 296.

When it is desired to open the wings from a latched position, the control valve 293 is shifted to the left, as viewed in FIG. 13, by means of a handle 297 in a manner interconnecting the pump P with the conduit 294'.

The sequencing valve 292' initially directs fluid through conduit 291R to the rod end of the locking cylinder 270 to unlatch the wing. In response to a build-up of pressure in line 291R, the sequencing valve shifts in conventional fashion to direct fluid to conduit 291P to pivot the wing section open. Fluid from the piston side of the locking cylinder and the rod side of the popper cylinder is exhausted sequentially through the sequencing valve 292 to the reservoir.

In a reverse manner when it is desired to close the wing section, the control valve 293 is shifted to the right to connect the pump P with the conduit 294. Fluid under pressure then passes through the sequencing valve 292 and sequentially to the rod side of the popper to close the wing and to the piston side of the locking cylinder to lock the wing.

SHREDDER ALIGNING UNIT

Subsequent to its discharge from the separator unit 2, the rind portion of the stalk material may be subjected to a chopping or shredding treatment. In such a case it is desirable that the rind elements be aligned longitudinally in preparation to entry into a shredder device. For this purpose a shredder aligning unit 3 is provided (FIG. 14). This unit is designed to receive rind material from the separator unit 2, in the form of elongate pieces, and align the pieces longitudinally in the direction of feed.

The shredder aligning unit 3 includes a base conveyor belt 300 which extends around a drive drum 302, and a pair of fore and aft idler pulleys 304 and 306. A tensioner roll 308 engages the belt periphery to maintain the proper belt tension. The drive drum, the forward idler pulley 304, and the tensioner roll 308 are affixed to a frame 310, with the rear idler pulley 306 being secured to an extension 312 thereof. A suitable driving motor (not shown) is connected to the drive drum 302 for driving the base conveyor belt 302.

Disposed above the conveyor belt 300 are a plurality of divider walls 314. The divider walls are arranged to define, in conjunction with the conveyor belt, a series of parallel feed paths 316. The base conveyor 300 and the walls 314 are oriented to position the feed paths beneath a feed chute 318 for the reception of rind material from the separator unit. A central one 314*c* of the divider walls extends vertically higher than the other divider walls and separates the feed paths into two groups to which the rind material is distributed. Located along the outer sides of the base conveyor and disposed slightly thereabove are end walls 318 which define the outer confines of the feed paths.

Figure 15:
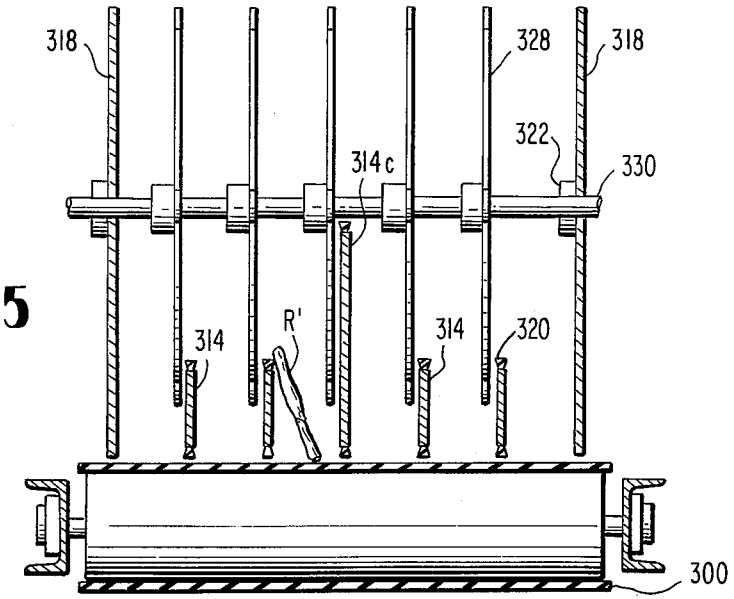
FIG. 15 is an enlarged, transverse sectional view of a shredder unit taken along section line 15—15 in FIG. 14.

The vertical faces of adjacent walls 314 are spaced by a distance which is less than the average length of the elongate pieces of rind. In this manner, rind which falls onto the feed paths will not lie horizontally on the conveyor belt unless they are generally aligned longitudinally, i.e., in the direction of travel. Those of the rind pieces R' which fall onto the aligning unit in a non-aligned condition may become situated as shown in FIG. 15 wherein they stand on the base conveyor 300 and lean against one of the divider walls 314. In order to displace these pieces toward an aligned posture, the divider walls are provided with endless aligner belts 320.

The aligner belts are disposed for travel along the upper and lower edges of the divider walls. In this connection, the divider walls are provided with fore and aft pulley wheels 322 and 324 around which the aligner belts are arranged. A suitable drive element is connected to the shaft 326 which mounts the forward pulleys 324 to drive the forward pulleys clockwise as viewed in FIG. 14. In this fashion, the upper extent of the aligner belts will travel forwardly in the same direction of movement as the upper extent of the base conveyor 300. The central divider wall 314*c* is provided with an aligner belt 320*c*. The aligner belt 320*c* extends around fore and aft pulleys 322*c* and 323 as well as around a forward drive pulley (not shown) which is secured to the drive shaft 326.

From the foregoing it will be understood that pieces of rind which lean against the divider walls will abut the aligner belts 320 and will be carried forwardly thereby. The drive shaft 326 of the drive pulleys 324 and the drive drum 302 of the conveyor belt 300 are driven at different speeds so that the respective ends of the leaning pieces of rind will travel forwardly at different rates. In this manner the rind will become gradually turned toward a longitudinally aligned posture until it falls from the aligner belts to an aligned posture as it is being fed forwardly toward the discharge end of the conveyor belt.

In the event that some pieces of rind become disposed across one or a pair of aligner belts, a series of kick-back wheels 328 are positioned at the forward end of the divider walls.

the kick-back wheels 328 are affixed to a drive rod 330 which is journaled in the end walls 318 by suitable bearings 332. Each kick-back wheel is positioned immediately adjacent one of the divider walls and is provided with a plurality of rounded tabs 334 extending from the outer peripheral edge of the wheel. The drive rod 330 is driven by a suitable motor to rotate the kick-back wheels clockwise, as viewed in FIG. 14. In this fashion, pieces of rind which are carried on the aligner belts will be engaged by the tabs 334 and flipped rearwardly in a manner which may impart a slight spinning, re-aligning, motion to the rind.

As the rind material reaches the forward end of the base conveyor, it is discharged into a shredder or chopper unit 336 located therebelow. A shredder and chopper which may be suitable are described in U.S. Pat. No. 3,567,511, mentioned above. In order to properly direct the rind material towards the cutter wheels 338 of the shredder, a gripping endless conveyor blanket 340 is provided. The gripping blanket projects around a pair of support drums 342 and 344 and is in contacting relation with the discharge end of the base conveyor at the point of transition where the horizontal movement of the rind is converted to vertical movement. Thus, the rind material will be sandwiched between the base conveyor and the gripping blanket as it is fed toward the shredder unit and will be positively fed to the shredder unit at a proper orientation. If desired, one of the drums 342 and 344 could be powered to drive the blanket at the same speed as the base conveyor.

SEPARATOR DRIVE SYSTEM

Associated with the separator unit 2 are a plurality of drive motors 350, 351 and 353. The motor 350 is utilized to supply rotary power to the feed rolls 72, the transfer rolls 92, and the gripping rolls 102 and 120. The motors 351 supply energy for rotating the base-mounted milling rolls 104, while the motors 353 rotate the wing-mounted milling rolls 122.

The motor 350 is drivingly connected via a belt 352 to the drive wheel 354 of a gear box 356. The gear box 356 includes gear means for driving a pulley assemblies 358 and 360. Each of the pulley assemblies 358 and 360 operates to drive identical parts of the separator and reference will be had solely with regards to that which is driven by the pulley assembly 360. The pulley assembly 360 has a pair of power take-off chains 362 and 364 connected thereto. The chain 362 operates to rotate rolls mounted on one of the wing sections, while the chain 364 operates to rotate base-mounted rolls associated with the other wing section.

The chain 362 is drivingly connected to the shaft of the feed roll 72 by means of a sprocket wheel 366 and a sprocket chain 368. The sprocket wheel 366 is rotatably mounted co-axially with respect to the wing pivot 66. In this manner, the wing may be pivoted away from the base without it being necessary to remove the sprocket chains 362 and 368.

From the feed roll 72 a further sprocket chian 370 is provided for connection with a sprocket wheel 372 for rotation of the outer transfer roll 92. This rotational force is transmitted by a chain 374 to a sprocket wheel 376 which operates the gripping roll 102 of the pith-milling station.

The chain 364 is connected to a sprocket wheel assembly 378 of the inner transfer roll 93. This rotational power is transmitted to the gripping roll 124 of the epidermis-milling station by means of a sprocket chain 380 and a sprocket wheel 382 operatively connected to the sprocket wheel assembly 378.

The relative sizes of the individual sprocket wheels and pulleys are selected so as to produce the proper rotational speed of the various rolls.

The milling rolls of the preferred separator unit are each provided with a separate drive motor. The motors 351 are connected to the milling rolls 104 of the pith-milling station. The motors 353 are suitably mounted on the wing sections and drive the milling rolls 122 of the epidermis milling stations.

OPERATION

In operation, cut stalk material is fed to the delivery unit 1 through the chute 9 and is longitudinally aligned in the manner described in U.S. Pat. No. 3,567,511. Such cut stalk material typically has been de-trashed and chopped to relatively uniform short lengths, such as described in U.S. Pat. 3,566,944. The aligned stalk pieces are fed along the belt 16 to the chute 32 where they are propelled against and slide down the deflector plate 34. The downwardly widening channels defined by the diverging surfaces 36' reduce the impedance to travel of the stalks and maintain a generally constant flow of stalk material to the separator unit. The yieldable guide plate 38 assists in directing the rapidly moving stalk into the nip zone of the feed rolls.

Stalk material entering the separator unit 2 is gripped and fed against the splitting blade 17 by the feed rolls 72, 72'. A positive gripping action of the feed rolls is facilitated during the slitting operation by the provision of apertures 76 through the feed roll, the flexible ridges 84, and the sharpened nails 86 (FIGS. 4–6). After being split, the stalk halves travel along the surfaces 90 and are gripped and fed by the transfer rolls 92 and 93 to the pith milling station 100. Here, the stalk halves are maintained in a flattened condition between the milling and gripping rolls 104 and 102. The flattened stalk is de-pithed by the milling roll as the travel speed of the stalk is being effectively controlled by the inclined teeth 108 of the gripping roll (FIG. 7). The remaining stalk portions are transferred along the guide plate 114, with the curved tip 118 of the guide plate tending to prevent a build-up of caught fibers form occurring.

Subsequently, in a separator unit employing an epidermis-milling station the stalk halves are passed between the milling and gripping rolls 122 and 124. Epidermis is milled away from the stalk by the milling roll 122, while the gripping roll 124 regulates the stalk speed.

When it becomes necessary to open a wing section 65, the locking cylinder 270 is retracted to remove the latch plate 272 from the bracket 284 (FIG. 12). Thereafter, the popper cylinder 250 is extended as the wing and base are separated (FIG. 11). Reverse sequential operation of the cylinders causes the wing to be swung closed and locked.

The hydraulic system described in connection with FIG. 13 may be utilized to automatically sequentially operate the popper and latching cylinders.

Removal of the powered rolls of the separator unit is accomplished by merely unscrewing the bolts 170 and 212 and removing the hollow axle members 156 and 204 from the sockets 164 and 209 (FIGS. 8 and 9). A reverse operation is performed for inserting the rolls.

Rind material which remains after the milling operation may be re-aligned and fed to a shredder unit 336 (FIG. 14). In accomplishing this, the rind is dropped onto the conveyor belt 302 where it falls into the feed paths 316 defined by the divider walls 314. Rind pieces R' which become oriented such that they lean against the aligner belts 320 (FIG. 15) will become gradually oriented as they travel forwardly, due to the different rates of forward movement of the base conveyor 302 and the aligning belts. Rind pieces which are carried along on the aligning belts are displaced therefrom by the kick-back wheels 328. The aligned pieces of rind are thereafter gripped between the conveyor belt and the gripping blanket 340 and are directed into the shredder unit 336.

MAJOR ADVANTAGES AND SCOPE OF THE INVENTION

The provision in a resilient feed roll of longitudinal apertures disposed parallel to the roll axis increases the resiliency of the roll and enables it to more effectively envelop stalk material being fed. The further provision of flexible ridges on the roll periphery enables the roll to conform more easily to the irregular shape of the stalks. The use of sharpened tines projecting from the feed roll facilitates a positive engagement between the roll and the stalk material. Each of these features enhances the control exerted by the feed roll over the stalk material to effectively feed the stalk material and resist skewing thereof.

The provision in a feed chute of channels which become gradually wider toward the discharge end reduces the impedance to travel of the stalk material and facilitates a constant flow thereof. The yieldable guide plate positioned at the discharge end of the chute tends to cushion the impact of stalk material striking thereagainst thereby reducing any tendency for the material to deflect from the proper discharge feed path.

The rotary axle mount of the invention serves to provide a rapid and simplified assemblage of the rotary roll members employed in the separator unit. The tapered roll-gripping portion of the axles enables a tight force-transmitting engagement to be established with the roll ends by means of a pair of tightening bolts. By affording complete passage of the axle members through their bearings, insertion and removal of the roll is accomplished with a minimal amount of interference. In addition, the use of a freely slidable axle member at one end of the roll enables thermal expansion of the roll to be accommodated.

The utilization of power-operated latching and opening mechanisms enables rapid access to the separator unit to be facilitated while maintaining an effective securement of the separator components during operation.

The aligning operation of the invention which utilizes aligner belts which travel at a different rate than the base conveyor yet in the same direction, assures that the elongate material will be aligned as it is being fed toward the conveyor discharge end. The further provision of kick-back wheels assures that material which may become caught on the aligner belts will be properly aligned.

The use of stalk-gripping rolls which includes a series of gripping teeth formed by non-radially extending surfaces affords a more effective control to be imparted to the stalk with less chance of damage occuring to the stalk fibers.

A stalk support plate which includes a rounded tip portion serves to guide stalks while resisting the build-up of stalk fibers thereon.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In an apparatus for separating sugarcane stalk material into component parts thereof comprising stalk feeding means, stalk-splitting means, and milling means for separating at least the pith component of the stalk material from the remainder of the stalk material, said stalk feeding means including a pair of oppositely-spaced, rotatable feed rolls, said feed rolls being driven and comprising:

a generally cylindrically-shaped body, at least an outer portion of said body being composed of a resilient material, and said outer portion having a plurality of apertures extending end-to-end therethrough;

a plurality of tines being mounted in said outer portion and projecting outwardly thereform;

said feed rolls being disposed to resiliently grip sugarcane stalk material therebetween and to impale the sugarcane stalk material with said tines to advance the sugarcane stalk material toward said stalk-splitting means.

2. A sugarcane stalk separating apparatus as defined in claim 1 and further including:

a base portion carrying said sugarcane stalk-splitting means;

at least one wing section being pivotally mounted to said base portion and carrying said sugarcane stalk-feeding means;

power-operated jack means operably connected between said base portion and said wing section for pivoting said wing section toward and away from said base portion; and power-operated latching means operably mounted on said base portion and said wing section for selectively locking and unlocking said wing section with respect to said base;

said latching means and said jack means being arranged, upon sequential operation thereof, to:

unlock said wing section from said base portion and swing open said wing section to operably disengage said wing section and said base portion; and swing said wing section closed and lock said wing section to said base portion to operably engage said wing section and said base portion.

3. A separating apparatus as defined in claim 1 and further including means for aligning and conveying sugarcane rind material having been separated from the sugarcane stalk material, said aligning and conveying means comprising:

a generally horizontally disposed base conveyor for conveying said sugarcane rind material from an intake end to a discharge end thereof;

a plurality of generally upstanding divider wall sections positioned above the base conveyor to define therewith a series of feed paths; and aligning belt means arranged to travel along at least the upper periphery of each of said divider wall sections toward the discharge end;

the rate of speed of the aligning belt means being maintained different from the rate of speed of said conveyor belt to cause the sugarcane rind material to become longitudinally aligned while being conveyed toward the discharge end.

4. A sugarcane stalk separating apparatus as defined in claim 1 wherein:

the peripheral surface of said outer portion is provided with a plurality of axially spaced grooves to define a series of flexible ridges;

said tines being mounted in said grooves and projecting radially outwardly beyond the outer surface of said ridges.

5. The apparatus according to claim 4 and further including a sugarcane stalk-deflecting chute arranged adjacent said feeding means and comprising:

a generally arc-shaped deflector plate having a concave surface;

a plurality of generally parallel walls extending outwardly from said concave surface to define with said deflector plate a series of channels;

said walls including faces which are convergent toward a discharge end of the chute to provide channels of gradually increasing width;

said channels being arranged to receive sugarcane stalk material directed along a first path of travel toward an intake end of the concave surface and to guide the sugarcane stalk material toward the discharge end of the chute for being discharged along a second path of travel toward said feeding means.

6. An apparatus as defined in claim 4 and further including a pair of transfer rolls positioned downstream of said splitting means for advancing split stalk material toward said milling means; said transfer rolls each comprising:

a generally cylindrically-shaped body, at least an outer portion of said body being composed of an elastomeric material;

the peripheral surface of said outer portion being formed with a plurality of axially-spaced grooves; and said body having a plurality of apertures extending end-to-end therethrough.

7. The apparatus according to claim 4 wherein:

said milling means comprises a pith-milling means;

said pith-milling means including a power-rotated milling roll and an oppositely-positioned power-rotated gripping roll;

said gripping roll being provided with a plurality of outwardly projecting gripping teeth arranged to grip oncoming sugarcane stalk material;

said gripping teeth including a plurality of outwardly converging surfaces;

said surfaces extending non-radially toward oncoming sugarcane stalk material, to resist the tendency for the teeth to impale the sugarcane stalk material as the sugarcane stalk material is gripped thereby;

a supporting plate being positioned downstream of said pith-milling means to support sugarcane stalk material as it is advanced therealong from said pith-milling means;

said supporting plate including an extension projecting towards a discharge zone defined by said pith-milling roll and said gripping roll;

said extension having a generally rounded configuration at its terminal end to facilitate the discharge of sugarcane stalk fibers therefrom.

8. An apparatus for separating sugarcane stalk material into component parts thereof comprising a base portion including stalk splitting means, at least one wing section pivotally mounted on said base portion and including means for feeding sugarcane stalk material to said splitting means, said base portion and said wing section further including milling means for separating components of the sugarcane stalk material, and means for manipulating said wing with respect to said base, said manipulating means including:

power-operated jack means operably connected between said base portion and said wing section for pivoting said wing section toward and away from said base portion; and power-operated latching means operably mounted on said base portion and said wing section for selectively locking and unlocking said wing section with respect to said base portion;

said latching means and said jack means being arranged, upon sequential operation thereof, to:

unlock said wing section from said base portion and swing open said wing section to operably disengage said wing section and said base portion; and swing said wing section closed and lock said wing section to said base portion to operably engage said wing section and said base portion.

9. An apparatus as defined in claim 8 wherein said latching means includes:

a hydraulic latching cylinder mounted on one of said base portion and said wing section, said cylinder including a reciprocal rod;

the outer end of said rod carrying means for engaging a slot carried by the other of said base portion and said wing section; and spring means operably connected between the outer end of said rod and said one of said base portion and said wing section;

said rod being spring-biased into its locking position and hydraulically retractable against the spring bias into its unlocking position.

10. An apparatus as defined in claim 8 wherein:

said power-operated jack means and said power-operated latching means include hydraulic cylinder means being interconnected for automatic sequential operation.

11. An apparatus for separating the components of sugarcane stalk material comprising stalk-splitting means; means for feeding sugarcane stalk material to said splitting means; and means for milling pith from the sugarcane rind portion of the sugarcane stalk material; the improvement wherein:

said pith-milling means includes a power-rotated milling roll and an oppositely-spaced, power-rotated gripping roll;

said gripping roll being provided with a plurality of gripping teeth;

said gripping teeth including a plurality of outwardly converging surfaces;

said surfaces extending non-radially toward oncoming sugarcane stalk material to resist the tendency for the teeth to impale the stalk material as the sugarcane stalk material is gripped thereby;

and a supporting plate being positioned downstream of said pith-milling means to support sugarcane stalk material as it is advanced therealong from said pith-milling means;

said supporting plate including an extension projecting toward a discharge zone defined by said pith-milling roll and said gripping roll;

said extension having a generally smooth configuration at its terminal end to facilitate the discharge of sugarcane stalk fibers therefrom.

12. An apparatus for separating sugarcane stalk material into component parts thereof comprising stalk-splitting means, rotary feed roll means for feeding sugarcane stalk material toward said splitting means, rotary milling roll means for separating components of the sugarcane stalk material, and rotary gripping roll means arranged opposite the milling roll means for regulating the speed of the sugarcane stalk material during milling thereof by said milling roll means; the ends of each of said feed roll means, milling roll means, and gripping roll means including outwardly open, inwardly tapered sockets and being supported at each end by a rotary mounting assembly, each rotary mounting assembly comprising:

rotary bearing means;

rotary axle means being mountable in said bearing means, said axle means including:

a hollow axle member comprising:

a rotational support portion extendable through and rotatably mountable in said bearing means, and a tapered gripping portion;

and tightening means extendable through said hollow axle member and engageable with a respective roll means for drawing together said tapered gripping portion and said tapered socket into rotation-transmitting engagement;

said rotational support portion and said gripping portion being dimensioned for passage through said bearing means.

13. An apparatus for separating sugarcane stalk material into its component parts comprising a base portion including sugarcane stalk splitting means, a pair of wing sections pivotally mounted on opposite sides of said base portion, each wing section carrying a feed roll for feeding sugarcane stalk material toward said splitting means; a deflecting chute for directing sugarcane stalk material to said feed rolls; said base portion and said wing sections including milling rolls for separating components of split sugarcane stalk material, and gripping rolls arranged oppositely to said milling rolls for regulating the speed of split stalk material being milled by said milling rolls; rotary mounting assemblies for rotatably supporting the ends of said feed rolls, milling rolls and gripping rolls; and means for manipulating said wing sections with respect to said base portion; the improvement wherein:

each of said feed rolls comprises:

a generally cylindrically-shaped body;

at least an outer portion of said body being composed of an elastomeric material;

the peripheral surface of said outer portion being provided with a plurality of axially-spaced grooves defining a series of outwardly projecting flexible ridges;

said outer portion having a plurality of apertures extending end-to-end therethrough;

a plurality of tines being mounted in said grooves and projecting outwardly therefrom;

said feed rolls being arranged to resiliently grip oncoming sugarcane stalk material, with the sugarcane stalk material being impaled by said tines to advance the sugarcane stalk material toward said stalk-spitting means;

said deflecting chute comprising:

a generally arc-shaped deflector plate having a concave surface;

a plurality of generally parallel walls extending outwardly from said concave surface to define with said deflector plate a series of channels;

said walls including faces which are convergent toward a discharge end of the chute to provide channels of gradually increasing width;

said channels being arranged to receive sugarcane stalk material directed along a first path of travel toward an intake end of the concave surface and to guide the sugarcane stalk material toward a discharge end of the chute for being discharged along a second path of travel toward said feeding means;

said rotary mounting assemblies each comprising:

rotary bearing means;

rotary axle means being mountable in said bearing means, said axle means including:

a hollow axle membeer comprising:

a rotational support portion extendable through and rotatably mountable in said bearing means, and a tapered gripping portion being tapered complementary to tapered socket means formed in the ends of said rolls;

and tightening means extendable through said hollow axle member and engageable with a respective roll for drawing together said tapered gripping portion and said socket means into rotation-transmitting engagement;

said rotational support portion and said gripping portion being dimensioned for passage through said bearing means;

the hollow axle member at one end of each roll being supported against longitudinal sliding movement within its bearing means;

the other hollow axle member being supported for limited longitudinal sliding movement within its bearing means;

said manipulating means comprising:

power-operated jack means operably connected between said base portion and said wing section for pivoting said wing sections toward and away from said base portion; and power-operated latching means mounted on said base portion and said wing section for selectively locking and unlocking said wing sections with respect to said base portion;

said latching means and said jack means being arranged, upon sequential operation thereof, to:

unlock said wing sections from said base portion and swing open said wing sections to operably disengage said wing sections and said base portion; and swing said wing sections closed and lock said wing sections to said base portion to operably engage said wing sections and said base portion.

14. A separating apparatus as defined in claim 13 and further including means for aligning and conveying sugarcane rind material comprising:

a generally horizontally disposed base conveyor for conveying sugarcane rind material from an intake end to a discharge end thereof;

a plurality of generally upstanding divider wall sections positioned above the base conveyor to define therewith a series of feed paths; and aligning belts arranged to travel along at least the upper periphery of each of said divider wall sections toward the discharge end;

the rate of speed of the aligning belts being maintained different from the rate of speed of said conveyor belt to cause the sugarcane rind material to become longitudinally aligned while being conveyed toward the discharge end;

a plurality of kick-back wheels being rotatably mounted adjacent the aligning belts near the discharge end;

a plurality of rounded projections extending from the periphery of each kick-back wheel; and means for rotating said kick-back wheels to displace sugarcane rind material from said aligning belts.

* * * * *